United States Patent [19]

Raymoure et al.

[11] 4,403,695

[45] Sep. 13, 1983

[54] HEAT-SHRINKABLE FILM WRAPPED PACKAGING

[75] Inventors: Russell A. Raymoure, Olathe; Richard P. Bechtel, Jr., Prairie Village; Ray Carson, Shawnee; Alva G. Don Carlos, Roeland Park, all of Kans.

[73] Assignee: Hallmark Cards, Inc., Kansas City, Mo.

[21] Appl. No.: 337,497

[22] Filed: Jan. 6, 1982

[51] Int. Cl.[3] ..... B65D 71/08; B65D 85/00; B65D 5/68

[52] U.S. Cl. ..... 206/497; 206/45.33; 206/432; 206/459; 206/315 R; 229/DIG. 12; 53/441

[58] Field of Search ..... 206/49 T, 45.33, 315, 206/432, 459; 53/441; 229/DIG. 12

[56] References Cited

U.S. PATENT DOCUMENTS

| | | | |
|---|---|---|---|
| 2,823,797 | 2/1958 | Moore | 206/45.33 |
| 3,410,396 | 11/1968 | Copping | 206/497 |
| 3,542,193 | 11/1970 | Hewlett et al. | 206/497 |
| 3,987,897 | 10/1976 | Smith | 206/497 |

*Primary Examiner*—William T. Dixson, Jr.

*Attorney, Agent, or Firm*—Neuman, Williams, Anderson & Olson

[57] ABSTRACT

A package and a method of packaging which involve a set-up carton or container devoid of sharp points at the corners thereof whereby an overwrap of a heat-shrinkable plastic applied to the carton is not subjected to stress forces at the package corners. An intermediate paper overwrap can be optionally utilized which is likewise not subjected to stress forces at the package corners.

12 Claims, 8 Drawing Figures

FIG. 1
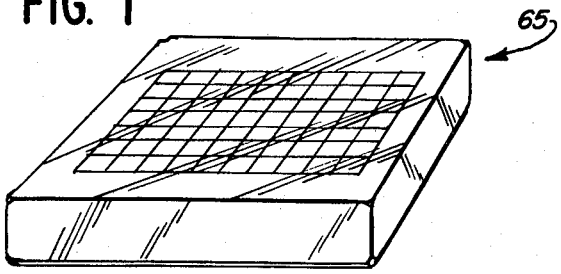
FIG. 2
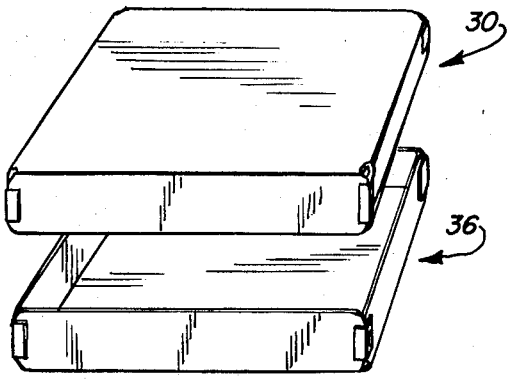
FIG. 3
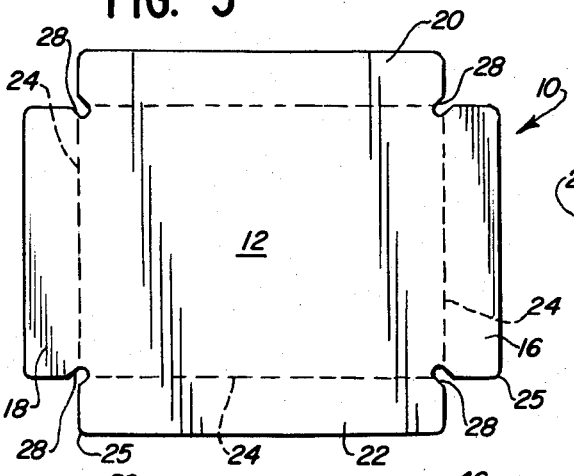
FIG. 4
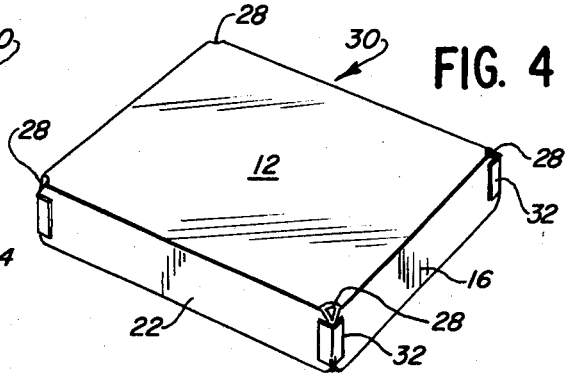
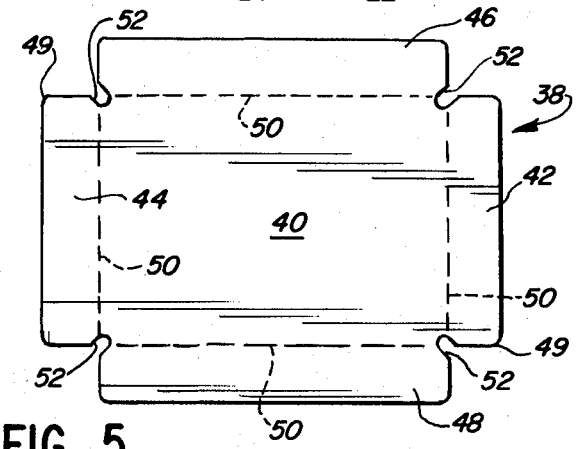
FIG. 5
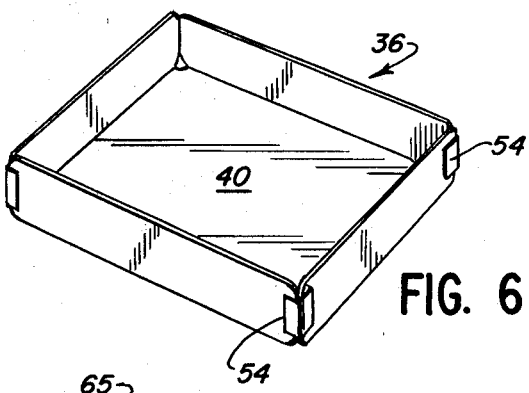
FIG. 6
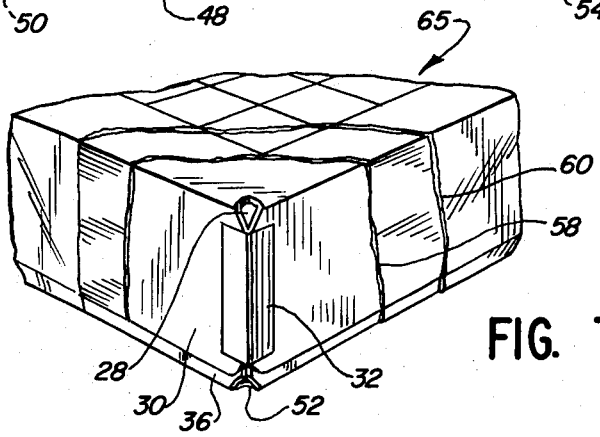
FIG. 7

HEAT-SHRINKABLE FILM WRAPPED PACKAGING

This invention relates to the art of packaging and more particularly the invention relates to improvements in the packaging art involving a carton having an overwrap. Still more particularly, the invention involves the packaging of materials in a carton which is overwrapped with a heat-shrinkable plastic film.

BACKGROUND AND SUMMARY OF THE INVENTION

Numerous articles are packaged in boxes or cartons fabricated of paperboard, fiberboard, chipboard and the like with the carton being enveloped by a heat-shrinkable plastic or shrink-type plastic film or overwrap. Many kinds of natural and synthetic polymers can be formed into relatively thin sheets of films (usually 3 mils or less). Films which shrink in length and/or width when heat is applied are known as shrink films. Such films when subjected to heat shrink up around an object in both high profile and low profile regions and conform to the object to give a neat, attractive package. Commercially available shrink-type films or heat-shrinkable plastics are formed from polyolefins such as polyethylene, polypropylene and copolymers thereof, polyvinyls, such as polyvinyl chloride, such as "Saran Wrap", polystyrene and the like. The use of shrink-type films as a package overwrap affords a number of advantages, with one major advantage being that it assures the purchaser as to the integrity of the packaged article or articles. Thus, for example, when a puzzle consisting of many pieces is packaged in a carton having an unbroken overwrap, the purchaser is assured that the package has not been opened with possible loss of one or more pieces of the puzzle. On the other hand, when an overwrap film on a packaged article is disrupted, torn or broken, the sales appeal of the package is greatly diminished with many prospective customers being reluctant or refusing to purchase the article. This problem is particularly acute for manufacturers of jigsaw puzzles for which the slightest imperfection in the integrity of the packaging creats a psychological barrier to purchase. This often occurs even when by close inspection it can be easily determined that a portion of the overwrap material only is torn or broken and the overwrapped carton itself has not been opened. This negative sales appeal to customers resulting from torn or broken overwrap on packages causes economic loss to retailers, distributors and manufacturers of packaged articles.

It is a principal object of this invention to provide a neat, attractive article container having an unbroken, heat-shrinkable plastic film overwrap thereon which gives assurance as to the integrity of the package.

It is another object of the invention to provide an article container overwrapped with a heat-shrinkable plastic film in which disruption or breakage of the plastic overwrap is significantly reduced.

It is another object of the invention to provide a neat, attractive container having a heat-shrinkable plastic overwrap which is much less susceptible to being torn or broken during distribution and display than shrink film overwrapped prior art containers.

It is a further object of the invention to provide a method of forming an article package having an unbroken, heat-shrinkable plastic overwrap thereon.

It is a still further object of the invention to provide a method of forming a package, including a carton and overwrap therefor, which method is simple and economical and provides a sturdy package on which the overwrap remains intact during distribution and display.

It is another object of the invention to provide a method of forming a package including a carton overwrapped first within an intermediate paper overwrap and finally with a heat-shrinkable plastic film.

In accordance with the invention, there is provided a packaging article comprising a carton characterized by the absence of sharp points at the corners thereof which is overwrapped with a heat-shrinkable plastic film such that the plastic film is not subjected to stress forces at the corners and thus resists breakage during handling, distribution and storage. The carton is formed of a rigid or semi-rigid material such as hardboard, chipboard, fiberboard and the like having a top and bottom and a plurality of sides disposed in angularly intersecting planes which define a plurality of angular corners and having portions of the apex regions of said corners cut-away so as to define a non-angular or blunt corner. The carton of the invention can be formed as a foldable box from a single blank or be composed of separable carton tray and lid components. In either case, the carton is formed with cut-out corners which do not present a sharp point or stress force to the plastic overwrap material.

The advantages and full nature of the invention will be understood from the accompanying drawings and the following disclosure and claims:

BRIEF DESCRIPTION OF THE DRAWINGS

FIG. 1 is a perspective view of a package embodying the present invention.

FIG. 2 is a perspective view of a carton used in forming a package in accordance with this invention with the carton having separate tray and lid components.

FIG. 3 is a bottom plan view of a scored and cut-out blank from which the carton lid of FIG. 2 is formed.

FIG. 4 is a perspective view of a carton lid used to form a package in accordance with this invention.

FIG. 5 is a top plane view of a scored and cut-out blank from which the carton tray of FIG. 2 is formed.

FIG. 6 is a perspective view of a carton tray used to form a package in accordance with invention.

FIG. 7 is a broken away, enlarged partial view of a complete preferred package in accordance with the invention.

Figure 8:
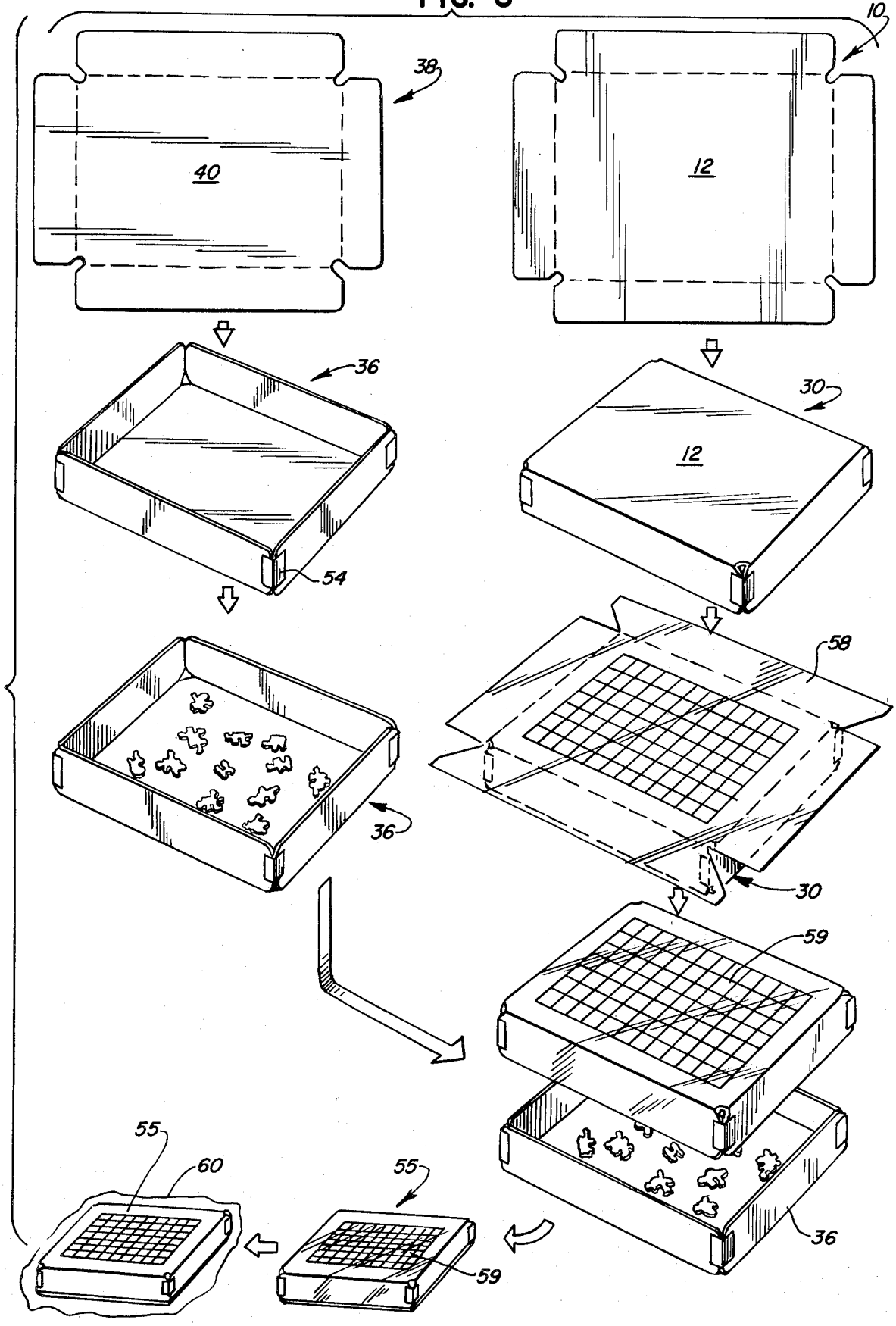
FIG. 8 shows schematically a method of forming a package in accordance with one preferred embodiment of the invention.

While the invention will be described in connection with a preferred embodiment, it will be understood that we do not intend to limit the invention to that embodiment. On the contrary, we intend to cover all alternatives, modifications and equivalents as may be included within the spirit and scope of the invention as defined by the appended claims.

DESCRIPTION OF THE PREFERRED EMBODIMENTS

Referring to the drawings in particular, the invention includes a lid blank generally designated 10 which includes a top panel 12. The blank 10, which can be square, rectangular or any other polygonal shape which normally in erected condition presents sharp corners, includes end flaps 16 and 18 and side flaps 20 and 22 which are demarcated from the top panel 12 by score lines 24. Preferably, the distal corners of the flaps 16, 18, 20 and 22 are somewhat rounded or arcuate, as illustrated by numeral 25. The four corners of the lid 30 are provided with cut-outs 28 formed by cutting away portions of the side and end panels and top panel 12. In the drawings the cut-outs 28 are shown as being generally U-shaped but these cut-outs can have other configurations such as round, square, triangular, etc.

By folding downwardly the end flaps 16 and 18 and side flaps 20 and 22 on the associated score lines 24, the side and end flaps are in erected abutting relationship as shown in FIG. 4 to form a lid 30. The carton lid 30 is secured in erected or set-up condition by applying short strips of an adhesive tape 32, such as "staying" tape of Kraftpaper or the like, to the abutting corners of the side and end flaps. Metal stiches, stays, glue or other suitable bonding devices can be used. In certain instances the bonding of the corners can be eliminated entirely relying only on the paper overwrap for containment.

The tray 36 of the container or carton is similarly formed from a tray blank 38 having a bottom panel 40, end flaps 42 and 44 and side flaps 46 and 48. The side and end flaps are demarcated from the bottom panel 40 by score lines 50. The tray 36 is identical in shape but slightly smaller in size than the lid 30 to permit the lid to fit snugly thereon. Thus, the blank 38 from which the tray is formed is correspondingly smaller in size than the blank 10 from which the lid is formed. In a preferred form, the distal corners of the flaps 42, 44, 46 and 48 are somewhat rounded or arcuate as at 49. The four corners of blank 38 are provided with cut-outs 52 formed by cutting away portions of the side and end flaps and bottom panel 40. Cut-outs 52 are preferably of the same configuration as are the cut-outs 28 on lid 30.

By folding upwardly the end flaps 42 and 44 and side flaps 46 and 48 on the associated score lines 50, the side and end flaps are in erected abutting relationship as shown in FIG. 6 to form tray 36. The tray 36 is secured in erected or set-up condition by applying short strips of an adhesive tape 54 to the abutting edges of the side and end flaps. Means other than tape can, however, be utilized to maintain both the lid 30 and tray 36 in set-up condition. Such means could include, for example, joining the side and end flaps by means of lock tabs and the like.

A preferred package 65 according to the invention is formed as diagrammatically shown in FIG. 8 by setting-up from suitably cut-out blanks the tray 36 and lid 30 with corners of each being suitably taped or otherwise held in abutting relationship.

In one embodiment illustrated, the lid is then encased in an intermediate paper overwrap 58 which can be decorative and/or imprinted with desired indicia 59 to identify the packaged article, the manufacturer, etc. For example, in the case of a packaged jigsaw puzzle, the intermediate paper overwrap can be imprinted to illustrate the complete, fully assembled packaged puzzle. Use of an intermediate paper overwrap is optional and it can, as is desired, overwrap the entire assembled carton 65 or partially cover the carton leaving the carton bottom exposed. In any event, merchandise such as the various individual pieces of a jigsaw puzzle are placed in the tray in a filling operation and the carton assembled by joining the lid and the tray. The assembled carton 55 containing the packaged article, such as a jigsaw puzzle, is then enveloped with a heat-shrinkable plastic film with the shrink-type film 60 being subjected to heat in accordance with procedures well-known in the art to cause it to shrink tightly around and conform to the carton. Various techniques known to the art for overwrapping an article with a shrink-type plastic film are known. In general, these techniques involve enveloping the article to be overwrapped with a sheet of a heat-shrinkable plastic, sealing the ends of the plastic sheet and subjecting the envelope to heat to cause the plastic shrink-type film to shrink tightly around the encased article. Air is generally exhausted through a small bleed hole provided in the film. Any suitable method of applying the shrink-type film to the carton can be employed.

A complete package 65 as illustrated in FIG. 1 is thus produced. By virtue of the cut-out corners 28 in the lid 30 and corners 52 in tray 36, the completed package is devoid of sharp film-disrupting points at all the corners of the carton. Sharp corners normally represent the points at which the shrink-type overwrap is subjected to greatest stress and where a high percentage of tearing or breaking is encountered in prior art packages. This problem is extremely acute when cartons having square pointed corners are subjected to an abrading action with other surfaces during shipment or while being packed or stacked with other cartons.

The size of the corner cut-outs of the carton is not critical and can be of a minimal size sufficient to eliminate sharp film-disrupting points at the corners. When the carton corner cut-outs are relatively small in size, there is usually no visible break or distortion in the continuity of the lines of the intermediate overwrap material or the final shrink-type overwrap. Excessively large corner cut-outs are less desired due to the possibility of the overwrap materials crunching at the cut-out and disrupting the continuity of the lines of the overwrap. Also, in instances where an intermediate overwrap material is not utilized, the carton corner cut-outs should not be of such large size as to permit escape of the package contents, such as pieces of a jigsaw puzzle.

The foregoing description describes a novel carton or box having a separate lid and tray component formed from blanks having cut-outs at the corner-forming portions of the blanks. The invention contemplates forming a carton devoid of sharp corner points from formable or foldable blank or blanks, suitably cut-out and scored to permit folding into a set-up completed carton.

Those modifications and equivalents which fall within the spirit of the invention are to be considered a part thereof.

What is claimed is:

1. A carton for packaging articles formed of a rigid or semi-rigid material having a top and bottom and a plurality of sides disposed in angularly intersecting planes which define a plurality of angular corners and having at least a portion of the apex regions of said corners cut out to a size insufficient to disrupt continuity in lines of a heat-shrinkable overwrap applied to the carton whereby the carton is characterized by the absence of sharp points at the corners thereof and is adapted for overwrapping with a heat-shrinkable plastic film whereby the stress forces on the plastic film at all of the corners of the carton are reduced, comprising a tray comprising a bottom panel square or rectangular in shape, upstanding side and end walls abutting with one another and engaged with the bottom panel at the edges thereof, means securing the upstanding side and end walls in abutting relationship, said tray having cut out portions at the corners thereof, a cover comprising a top panel structure similar in shape but somewhat larger than said bottom panel, downturned side and end walls abutting with one another and engaged with the top panel at the edges thereof, means securing the downturned side and end walls in abutting relationship, said cover having cut out portions at the corners thereof.

2. A carton in accordance with claim 1 wherein the means for securing the side and end walls of the tray and cover in abutting relationship is a tape means.

3. A package adapted for receiving and holding articles comprising a carton formed of a rigid or semi-rigid material having a top and bottom and a plurality of sides disposed in angularly intersecting planes which define a plurality of angular corners and having at least a portion of the apex regions of said corners cut out to a size insufficient to disrupt continuity in lines of a heat-shrinkable overwrap applied to the carton whereby the carton is characterized by the absence of sharp points at the corners thereof and adapted for overwrapping with a heat-shrinkable plastic film whereby the stress forces on the plastic film at all of the corners of the carton are reduced, an intermediate paper overwrap on at least a portion of said carton being unsupported at the cut out portions of the carton and collapsible therein, and a heat-shrinkable plastic film overwrapped on said carton with the stress forces on said plastic film at the corners of the carton being reduced.

4. A package in accordance with claim 3 wherein the carton is formed from a single blank which is cut out at the corner-forming portions thereof.

5. A package in accordance with claim 3 wherein the carton has separate tray and lid components with both tray and lid components being formed from blanks cut out at the corner-forming portions thereof.

6. A package in accordance with claim 3 wherein the intermediate paper overwrap contains indicia on the outer surface thereof.

7. A method of packaging which comprises providing a carton formed of a rigid or semi-rigid material having a top and bottom and a plurality of sides disposed in angularly intersecting planes which define a plurality of angular corners and having at least a portion of the apex regions of said corners cut out to a size insufficient to disrupt continuity in lines of a heat-shrinkable overwrap applied to the carton whereby the carton is characterized by the absence of sharp points at the corners thereof and adapted for overwrapping with a heat-shrinkable plastic film whereby the stress forces on the plastic film at all of the corners of the carton are reduced, inserting into said carton an article to be packaged, then applying to the carton an overwrap of a heat-shrinkable plastic film whereby the stress forces on the plastic film at all of the corners are reduced.

8. A method in accordance with claim 7 wherein the carton is provided with cut out portions at each corner thereof.

9. A method in accordance with claim 7 wherein the carton is formed from a single blank which is cut out at the corner-forming portions thereof.

10. A method in accordance with claim 7 wherein the carton is composed of separate tray and lid components with both the tray and lid components being formed from blanks cut out at the corner-forming portions thereof.

11. A method in accordance with claim 7 wherein an intermediate paper overwrap is applied to the carton prior to application of the heat-shrinkable plastic film overwrap.

12. A method in accordance with claim 11 wherein the intermediate paper overwrap contains indicia on the outer surface thereof.

* * * * *